US007574159B2

(12) United States Patent
Choi

(10) Patent No.: US 7,574,159 B2
(45) Date of Patent: Aug. 11, 2009

(54) IMAGE FORMING APPARATUS AND METHOD OF PREVENTING CARRIER FROM ADHERING TO PHOTO RECEPTOR

(75) Inventor: Jeong-jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 155 days.

(21) Appl. No.: 11/371,074

(22) Filed: Mar. 9, 2006

(65) Prior Publication Data

US 2006/0204279 A1 Sep. 14, 2006

(30) Foreign Application Priority Data

Mar. 9, 2005 (KR) ..... 10-2005-0019576

(51) Int. Cl.
*G03G 21/00* (2006.01)

(52) U.S. Cl. ..... 399/128

(58) Field of Classification Search ..... 399/128
See application file for complete search history.

(56) References Cited

U.S. PATENT DOCUMENTS

| | | | | |
|---|---|---|---|---|
| 5,282,007 | A | 1/1994 | Oshiumi | |
| 5,303,011 | A * | 4/1994 | Noguchi et al. | 399/58 |
| 5,426,489 | A * | 6/1995 | Haneda et al. | 399/175 |
| 5,809,391 | A * | 9/1998 | Fujita et al. | 399/396 |
| 6,539,189 | B2 * | 3/2003 | Yanagida | 399/167 |
| 2002/0034401 | A1 * | 3/2002 | Yanagida | 399/167 |

FOREIGN PATENT DOCUMENTS

| | | | |
|---|---|---|---|
| JP | 58130354 | A * | 8/1983 |
| JP | 62201470 | A * | 9/1987 |
| JP | 02183282 | A * | 7/1990 |
| JP | 03031879 | A * | 2/1991 |
| JP | 04014062 | A * | 1/1992 |
| JP | 07-129035 | | 5/1995 |
| JP | 11-344909 | | 12/1999 |
| JP | 2000098848 | A * | 4/2000 |
| JP | 2000122498 | A * | 4/2000 |
| JP | 2000-267532 | | 9/2000 |
| JP | 2000-292993 | | 10/2000 |
| KR | 1999-29302 | | 7/1999 |

OTHER PUBLICATIONS

Office Action issued in Korean Patent Applicant No. 2005-19576 on Sep. 20, 2006.
Product Description of Kenwood VT-182 1-Channel 10uV to 300V Electronic Voltmeter.

* cited by examiner

*Primary Examiner*—Quana M Grainger
(74) *Attorney, Agent, or Firm*—Stein McEwen, LLP

(57) ABSTRACT

An image forming apparatus and a method of preventing a carrier from adhering to a photosensitive drum are provided. The image forming apparatus includes a photosensitive drum on which an electrostatic latent image is formed by an exposure unit, a main motor which rotates the photosensitive drum, an eraser unit which removes a potential charged on the photosensitive drum, and a controller which controls the eraser unit to remove a potential of the photosensitive drum while the photosensitive drum rotates due to an inertial force after the main motor stops rotating.

13 Claims, 4 Drawing Sheets

IMAGE FORMING APPARATUS AND METHOD OF PREVENTING CARRIER FROM ADHERING TO PHOTO RECEPTOR

CROSS-REFERENCE TO RELATED APPLICATIONS

This application claims the benefit of Korean Patent Application No. 2005-19576, filed Mar. 9, 2005, in the Korean Intellectual Property Office, the disclosure of which is incorporated herein by reference.

BACKGROUND OF THE INVENTION

1. Field of the Invention

An aspect of the present invention relates to an image forming apparatus and a method of preventing a carrier from adhering to a photo receptor.

2. Description of the Related Art

In general, an image forming apparatus prints a desired image by forming an electrostatic latent image on a photosensitive medium using an exposure unit, such as a laser scanning unit, in response to a digital image signal, developing a toner image by supplying a toner to the electrostatic latent image, transferring the toner image onto a print medium, and fixing the toner image on the print medium by applying heat and pressure to the toner image.

Image forming apparatuses are classified into a dry type and a wet type according to a state of a toner and carrier generally used. The wet-type dry image forming apparatuses are also classified into two types: an apparatus having a one-phase developing device, and an apparatus having a two-phase developing device.

The one-phase developing device forms an image by supplying only a toner to the electrostatic latent image, while the two-phase developing device forms an image by supplying a carrier mixed with toner particles to the electrostatic latent image.

With regard to the one-phase developing device, after the toner is applied onto a photosensitive medium to develop a toner image, the toner left on a surface of the photosensitive medium is removed by a cleaning blade, and is recovered by a recovery unit to recycle the toner.

With regard to the two-phase developing device, after toner particles are supplied onto the photosensitive medium to develop the toner image, the toner particles left on a surface of the photosensitive medium are removed by a cleaning blade, and recovered by a recovery unit to recycle the toner.

However, in the two-phase developing device, when the cleaning blade removes the particles, adhesion of the carrier onto the photosensitive medium wears out the surface of the photosensitive medium, thereby grading down the performance of the photosensitive medium. Even though the carrier is removed from the surface of the photosensitive medium by the cleaning blade, the carrier abrades the cleaning blade. Therefore, the carrier preferably should not be adhered to the surface of the photosensitive medium.

A conventional image forming apparatus generally includes a photosensitive medium and a developing device. Also, the conventional image forming apparatus includes a charger for charging the photosensitive medium to a predetermined potential, and an eraser for removing the potential charged on the photosensitive medium, both of which are disposed around the photosensitive medium. The developing device has a developing roller for supplying the toner onto the electrostatic latent image formed on the photosensitive medium to develop the latent image as the toner image, and a mixing roller for homogenously mixing the toner with the carrier to prevent mixed particles from curing.

The developing roller and the mixing roller are connected to and driven by a main motor rotating the photosensitive medium. Hence, the developing roller and the mixing roller do not operate when the main motor is turned off. Also, when the main motor is turned off, the charger and eraser are also turned off. In other words, when the main motor is turned off, the developing roller, the mixing roller, the charger, and the eraser are all consequently turned off.

However, when the main motor is turned off, the photosensitive medium still rotates for a dwell period of time due to an inertial force. At this time, the charger and the eraser are also turned off, so that the potential required for development is cut off. The carrier is adhered to the surface of the photosensitive medium due to potential difference.

Examples of a method of preventing the carrier from adhering to the surface of the photosensitive medium which rotates after the main motor is turned off are disclosed in U.S. Pat. No. 6,212,339 entitled "Image Forming Apparatus with Discharging Exposure after Shutdown," issued to Inoue, et al., on Apr. 3, 2001, and U.S. Pat. No. 6,070,032 entitled "Electrostatic Printing Apparatus Having an Erase Lamp," issued to Rokutanda, et al., on May 30, 2000.

However, the above methods are complicated, and accordingly a method of easily and effectively preventing the carrier from adhering to the surface of the photosensitive medium is required.

SUMMARY OF THE INVENTION

Accordingly, one aspect of the present invention provides an image forming apparatus and a method of preventing a carrier from adhering to a surface of a photosensitive medium due to potential difference, in which a potential is removed from the surface of the photosensitive medium while the photosensitive medium rotates by an inertial force.

Additional aspects and/or advantages of the invention will be set forth in part in the description which follows and, in part, will be obvious from the description, or may be learned by practice of the invention.

According to one aspect of the present invention, there is provided an image forming apparatus comprising: a photosensitive drum on which an electrostatic latent image is formed by an exposure unit; an eraser unit to remove a potential charged on the photosensitive drum; and a controller controlling the eraser unit to remove the potential of the photosensitive drum, while the photosensitive drum rotates due to an inertial force after a main motor for rotating the photosensitive drum stops rotating.

According to another aspect of the present invention, there is provided a method of preventing a carrier from adhering to a photosensitive drum, comprising: stopping a main motor; comparing an average voltage of a toner during rotation of the photosensitive drum with a stationary voltage of the toner when the photosensitive drum stops rotating; and if the average voltage of the toner is different from the stationary voltage of the toner, turning off an eraser unit.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
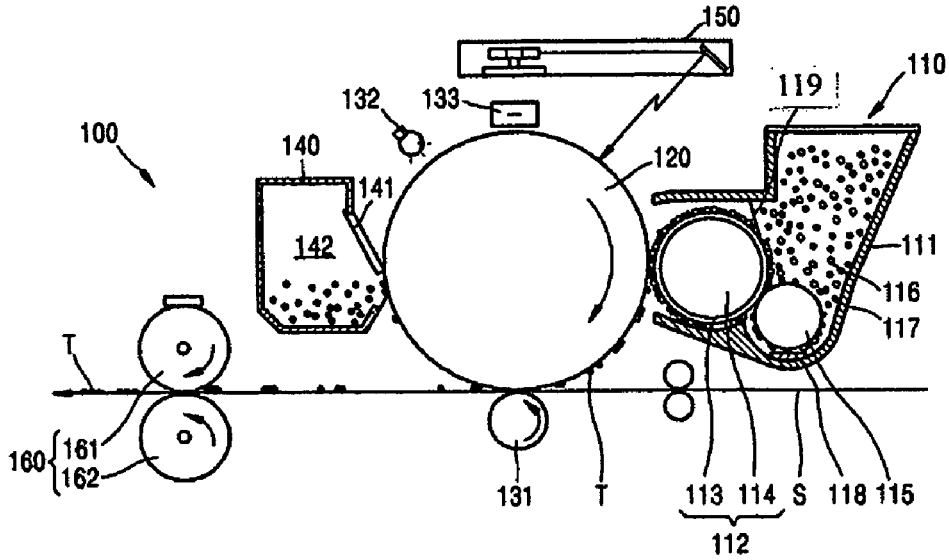
FIG. 1 is a schematic view illustrating an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Referring to FIG. 1, an image forming apparatus 100 according to an embodiment of the present invention includes a developing unit 110, a photosensitive drum 120, an eraser unit 132, a charging unit 133, a cleaning unit 140, an exposure unit 150, and a fixing unit 160.

The developing unit 110 includes a housing 111 for storing a developer prepared by mixing a positively-charged carrier 116 with a toner 117, a mixer for agitating the developer in the housing 111 to prevent the developer from being cured, a developing roller 112 rotatably installed to the housing 111 and supplying the toner 117 onto an electrostatic latent image formed on the photosensitive drum 120 to develop an electrostatic latent image as a toner image T, in which a surface of the developing roller facing the photosensitive drum 120 is exposed to the housing 111, and a restricting blade 119 for restricting a thickness of the developer adhered on a surface of the developing roller 112.

The developing roller 112 has a rotatable spacer 113, the toner 117 and the carrier 116 adhering to a surface of the spacer 113, and a magnetic roller 114 fixed in the spacer 113 for preventing the positively-charged carrier 116 transferred to the photosensitive drum 120 from being adhered to the photosensitive drum 120 and recovering the carrier 116 by properly arranging a negative pole and a positive pole. A structure of the magnetic roller 114 has no concern with the present invention, the description of which will not be described herein.

The housing 111 is provided at an inner surface thereof with a sensor 118 for measuring a voltage of the toner 117. The sensor 118 measures an average voltage X of the toner 117 during rotation of the mixer 115 or a stationary voltage Y of the toner 117 when the mixer 115 stops operating.

An electrostatic latent image is formed on the surface of the photosensitive drum 120 by the exposure unit 150 (for example, a laser scanning unit) radiating light. The electrostatic latent image is developed as the toner image T by the toner 117 supplied from the developing roller 112. The toner image T formed on the surface of the photosensitive drum 120 is transferred on a print sheet S by the transfer roller 131 in contact with the photosensitive drum 120.

The charging unit 133 charges the surface of the photosensitive drum 120 to a desired potential, while the eraser unit 132 removes the potential charged on the surface of the photosensitive drum 120. The eraser unit 132 is disposed before the charging unit 133 when the eraser unit 132 is disposed around the photosensitive drum 120 in a clockwise direction. Hence, the developing unit 110, the transfer roller 131, the cleaning unit 140, the eraser unit 132, the charging unit 133, and the exposure unit 150 should be disposed in a clockwise direction to smoothly form the electrostatic latent image and develop the electrostatic latent image as the toner image T which is transferred on the print sheet S.

The cleaning unit 140 includes a cleaning blade 141 disposed in contact with the surface of the photosensitive drum 120 so as to remove the toner 117 left on the surface of the photosensitive drum 120. The toner 117 removed by the cleaning blade 141 is stored in a waste storage portion 142.

The fixing unit 160 fixes the transferred toner image T onto the print sheet S, and includes a heating roller 161 for generating heat and a pressing roller 162 disposed opposite to the heating roller 161 for pushing the print sheet S against the heating roller 161.

Figure 2:
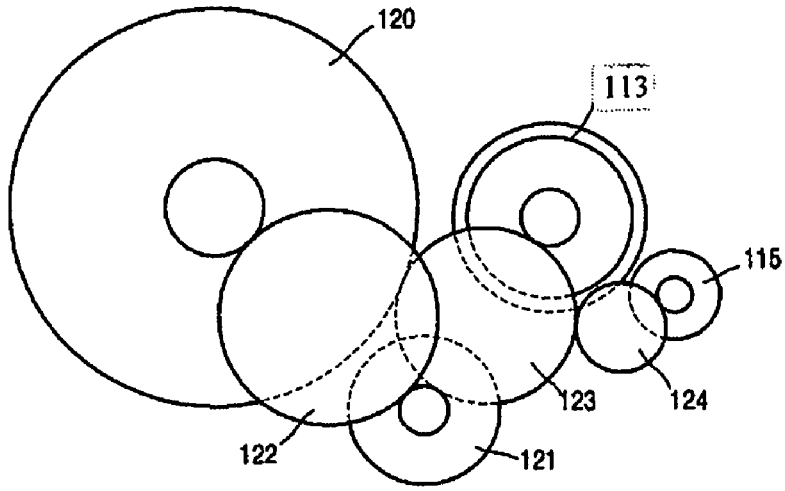
FIG. 2 is a view illustrating a power transmitting train of the image forming apparatus shown in FIG. 1.

FIG. 2 shows a power transmitting train of the image forming apparatus shown in FIG. 1.

Referring to FIG. 2, the photosensitive drum 120 is connected to a main motor 121 via a coupling gear 122. The spacer 113 is connected to the main motor 121 via a coupling gear 123. The mixer 115 is connected to the coupling gear 123 via a coupling gear 124. Hence, when the main motor 121 rotates, the photosensitive drum 120, the spacer 113, and the mixer 115 are concurrently driven by the power transmitted from the main motor 121. In contrast, when the spacer 113 rotates when the main motor 121 stops operating, the photosensitive drum 120 and the mixer 115 are driven by a rotational force of the spacer 113.

Figure 3:
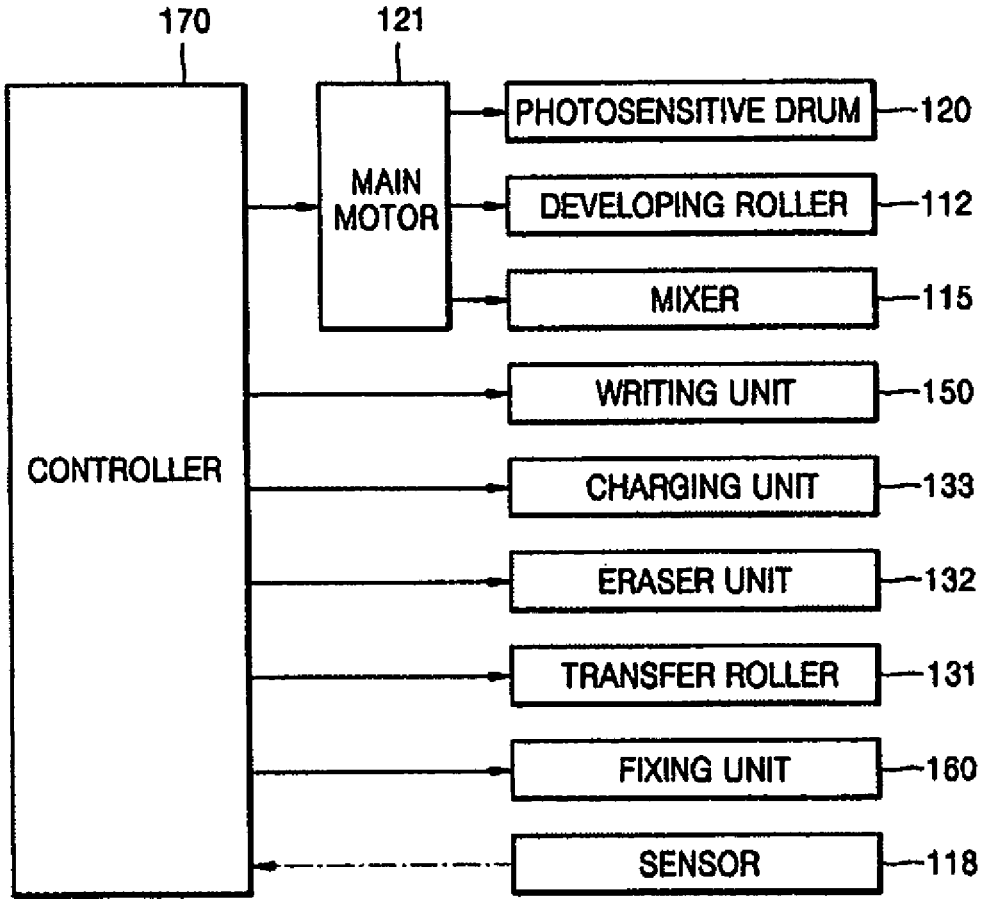
FIG. 3 is a view illustrating a procedure of transmitting a control signal from a controller.

FIG. 3 shows a procedure of transmitting a control signal from a controller 170.

Referring to FIG. 3, the controller 170 is connected to the main motor 121 to transmit the control signal to it, and the main motor 121 is connected to the photosensitive drum 120, the developing roller 112, and the mixer 115, as shown in FIG. 2. The controller 170 is also connected to the exposure unit 150, the charging unit 133, the eraser unit 132, the transfer roller 131, and the fixing unit 160 to transmit the control signal to them.

The controller 170 is connected to the sensor 118 to detect the voltage of the toner stored in the developing unit 110. The controller 170 compares the detected value with a set value so as to measure a rotating time of the photosensitive drum 120 due to an inertial force immediately after the main motor 121 stops operating. The controller 170 controls the eraser unit 132 to remove the potential charged on the surface of the photosensitive drum 120, while the photosensitive drum 120 rotates due to the inertial force. Consequently, it is possible to prevent the carrier 116 from adhering onto the photosensitive drum 120 due to the potential difference.

Figure 4:
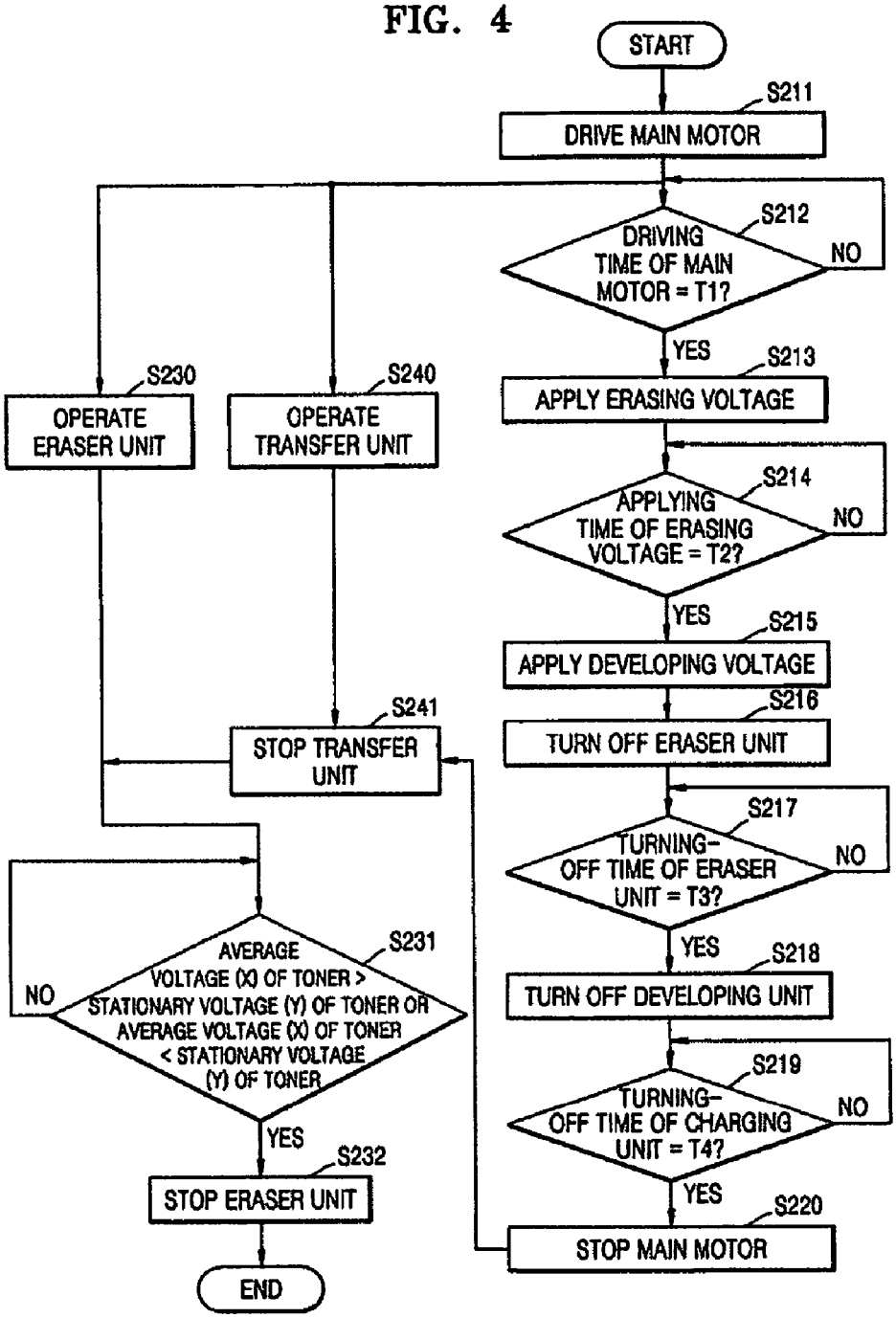
FIG. 4 is a flowchart illustrating a process of preventing a carrier from adhering to a photosensitive drum according to an embodiment of the present invention.
Figures 5A, 5B, 5C, 5D:
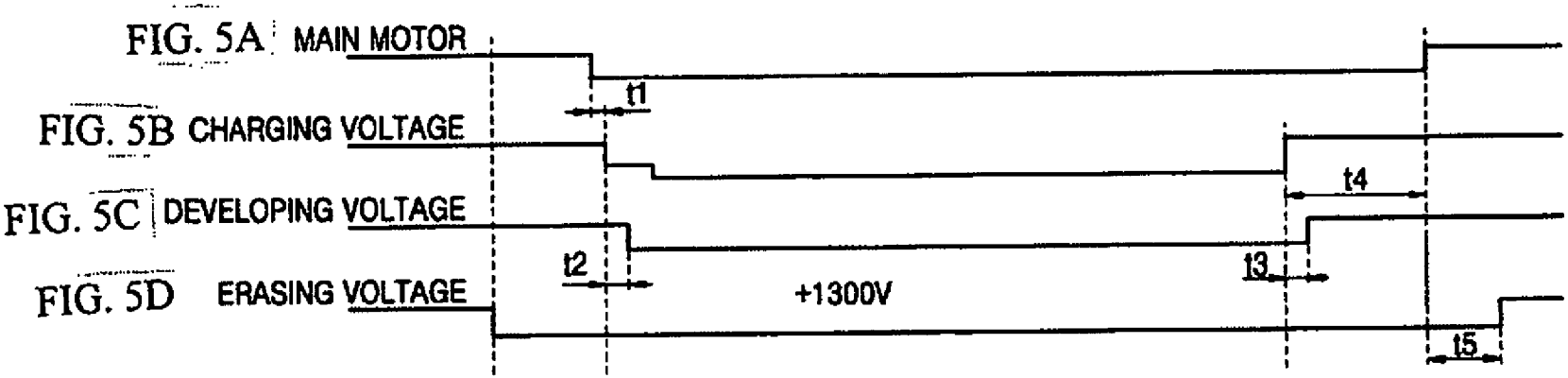
FIGS. 5A, 5B, 5C and 5D are timing diagrams for preventing the carrier from adhering to the photosensitive drum corresponding to the main motor, the charging voltage, the developing voltage and the erasing voltage, respectively, as shown in FIG. 4.

FIG. 4 is a flowchart illustrating a process of preventing the carrier from adhering to the photosensitive drum according to an embodiment of the present invention. FIGS. 5A, 5B, 5C and 5D are timing diagrams for preventing the carrier from adhering to the photosensitive drum corresponding to the main motor, the charging voltage, the developing voltage and the erasing voltage, respectively, as shown in FIG. 4.

Referring to FIGS. 4, 5A, 5B, 5C, and 5D, when the main motor 121 operates (S211), the photosensitive drum 120 connected to the main motor 121, the spacer 113 of the developing roller 112, and the mixer 115 are concurrently driven.

At this time, an erasing voltage is applied to the eraser unit 132 to remove the potential charged on the surface of the photosensitive drum 120 (S230). The transfer unit 160 operates, and power is supplied to the heating roller 161 to generate heat, so that the toner image T is fixed onto the print sheet S passing through an interface between the heating roller 161 and the pressing roller 162 (S240).

The controller 170 determines whether the main motor 121 operates during a time t1 (S212). The controller 170 applies the charging voltage to the charging unit 133 to charge the surface of the photosensitive drum 120 to a desired potential, if the main motor 121 operates during the time t1 (S213). At this time, the operating time t1 of the main motor 121 may be 20 ms. If the main motor 121 does not operate during the time t1, operation S212 is performed.

The controller 170 determines whether a time during which the charging voltage is applied to the charging unit 133 is a time t2 (S214). If the charging unit 133 operates and the charging voltage is applied during the time t2, the controller 170 applies a developing voltage to the developing unit 110 (S215). At this time, the time t2 when the charging unit 133 operates and the charging voltage is applied may be 80 ms.

If the charging voltage is applied to the developing unit 110, the developing roller 112 supplies the toner 117 to the electrostatic latent image formed on the photosensitive drum 120 to develop the latent image as the toner image T, and the toner image T is transferred onto the print sheet S by the transfer roller 131.

After the image to be printed is completely printed on the print sheet S, the charging voltage is not applied to the charging unit 133, thereby stopping the printing operation (S216).

The controller 170 determines whether a time when it interrupts the charging voltage applied to the charging unit 133 is t3 (S217). If so, the controller 170 interrupts the developing voltage applied to the developing unit 110 (S218). The time t3 when the charging voltage is no longer applied to the charging unit 133 may be 80 ms. If the time t3 is not 80 ms, the controller 170 proceeds to the operation S217.

The controller 170 determines whether a time when it interrupts the charging voltage applied to the charging unit 133 is t4 (S219). If so, the controller 170 stops the operation of the main motor 121 (S220). The time t4 may be 620 ms. If the time t4 is 620 ms, the controller 170 proceeds to the operation S219.

The controller 170 stops the operation of the transfer roller 131 when the main motor 121 stops rotating (S241).

After that, the controller 170 measures a time t5 from the time when the main motor 121 stops operating to the time when the photosensitive drum 120 rotates by an inertial force.

Specifically, the controller 170 receives from the sensor 118 the average voltage X of the toner 117 when the photosensitive drum 120 rotates and the stationary voltage Y of the toner 117 when the photosensitive drum 120 stops rotating, and determines whether the average voltage X is larger than the stationary voltage Y or the stationary voltage Y is larger than the average voltage X.

Even though the main motor 121 stops operating, the photosensitive drum 120 rotates by an inertial force. Hence, the mixer 115 connected to the photosensitive drum 120 also rotates, as shown in FIG. 2. As a result, the sensor 118 detects the same average voltage X of the toner 117 as that in the case where the main motor 121 rotates, while the photosensitive drum 120 rotates by the inertial force.

Consequently, when the photosensitive drum 120 stops rotating, the mixer 115 also stops rotating. The sensor 118 can measure the stationary voltage Y of the toner 117 at the time when the photosensitive drum 120 stops rotating.

If the average voltage X of the toner 117 is larger than the stationary voltage Y or the stationary voltage is larger than the average voltage X, i.e., if the voltage of the toner 117 changes, the controller 170 interrupts the erasing voltage applied to the eraser unit 132 (S232). Accordingly, the time t5 represents the time from when the photosensitive drum 120 begins to rotate due to an inertial force, corresponding to the time at which the main motor 121 stops operating, to when the voltage of the toner 117 changes.

If the average voltage X of the toner 117 is larger than the stationary voltage Y or the stationary voltage Y is not larger than the average voltage X, the controller proceeds to the operation S231. The controller 170 determines whether the average voltage X of the toner 117 is compared with the stationary voltage Y, since the photosensitive drum 120 continuously rotates by an inertial force.

With the above description, after the main motor stops rotating, the image forming apparatus according to the present invention measures the rotating time of the photosensitive drum due to inertial force, and removes the potential of the photosensitive drum by the erasing voltage applied to the photosensitive drum from the eraser unit during this time, which prevents the carrier from adhering to the surface of the photosensitive drum to reduce abrasion of and improve the lifetime of the cleaning unit.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a photosensitive drum on which an electrostatic latent image is formed by an exposure unit;

a developing unit accommodating toner to develop the electrostatic latent image;

a main motor which rotates the photosensitive drum and operates the developing unit;

an eraser unit which removes a potential charged on the photosensitive drum;

a controller which controls the eraser unit to remove a potential of the photosensitive drum while the photosensitive drum rotates due to an inertial force after the main motor stops rotating; and a sensor which measures an average voltage of the toner in the developing unit during rotation of the photosensitive drum and a stationary voltage of the toner in the developing unit when the photosensitive drum stops rotating.

2. The image forming apparatus according to claim 1, wherein the controller compares the average voltage to the stationary voltage to calculate an inertial rotating time of the photosensitive drum.

3. The image forming apparatus according to claim 2, wherein the controller starts measuring the inertial rotating time of the photosensitive drum immediately after the main motor stops operating.

4. The image forming apparatus according to claim 3, wherein the controller stops measuring the inertial rotating time of the photosensitive drum when the average voltage of the toner during rotation of the photosensitive drum becomes larger or smaller than the stationary voltage of the toner.

5. A method of preventing a carrier from adhering to a photosensitive drum, comprising:

stopping a main motor which rotates the photosensitive drum;

comparing an average voltage of a toner during rotation of the photosensitive drum with a stationary voltage of the toner when the photosensitive drum stops rotating; and turning off an eraser unit, if the average voltage of the toner is different from the stationary voltage of the toner.

6. The method according to claim 5, wherein the eraser unit is turned on after the main motor stops rotating.

7. The method according to claim 6, further comprising measuring the average voltage of the toner during rotation of the photosensitive drum and the stationary voltage of the toner when the photosensitive drum stops rotating.

8. An image forming apparatus, comprising:

a photosensitive drum;

a developing unit accommodating a toner which adheres to the photosensitive drum due to a potential charged on the photosensitive drum a main motor which rotates the photosensitive drum and operates the developing unit;

an eraser unit which removes the potential charged on the photosensitive drum, wherein the eraser unit removes the potential on the photosensitive drum and thereby stops the toner in the developing unit from adhering to the photosensitive drum until the photosensitive drum stops rotating from an inertial force after the main motor stops operating; and a sensor which measures an average voltage of the toner in the developing unit when the photosensitive drum is rotating and a stationary voltage of the toner in the developing unit when the photosensitive drum stops rotating.

9. An image forming apparatus, comprising:

a photosensitive drum;

a developing unit accommodating a toner;

a main motor which rotates the photosensitive drum and operates the developing unit;

a carrier mixed with the toner which adheres to the photosensitive drum due to a potential charged on the photosensitive drum;

a cleaning unit which cleans the toner off the photosensitive drum;

an eraser unit which removes the potential on the photosensitive drum while the photosensitive drum rotates due to an inertial force after the main motor stops operating to reduce abrasion of the cleaning unit caused by the carrier; and a sensor which measures an average voltage of the toner in the developing unit during rotation of the photosensitive drum and a stationary voltage of the toner in the developing unit when the photosensitive drum stops rotating to calculate an inertial rotating time of the photosensitive drum.

10. The image forming apparatus according to claim 9, wherein the sensor measures the inertial rotating time of the photosensitive drum immediately after the main motor stops operating.

11. The image forming apparatus according to claim 10, wherein the sensor stops measuring the inertial rotating time of the photosensitive drum when the average voltage of the toner in the developing unit during rotation of the photosensitive drum becomes larger or smaller than the stationary voltage of the toner.

12. A method of preventing a carrier from adhering to a photosensitive drum, comprising:

stopping a main motor which rotates the photosensitive drum and operates a developing unit accommodating a toner therein; and keeping an eraser unit turned on after the main motor stops until the photosensitive drum stops rotating due to an inertial force, thereby reducing abrasion of a cleaning unit;

wherein a time of rotation of the photosensitive drum due to the inertial force is measured by comparing an average voltage of the toner in the developing unit during rotation of the photosensitive drum with a stationary voltage of the toner in the developing unit when the photosensitive drum stops rotating.

13. The method of claim 12, wherein the eraser unit turns off if the average voltage of the toner in the developing unit is different from the stationary voltage of the toner in the developing unit.

* * * * *